US005687968A

United States Patent [19]

Tarantino

[11] Patent Number: 5,687,968

[45] Date of Patent: Nov. 18, 1997

[54] WAGERING SYSTEM

[75] Inventor: Elia R. Tarantino, Reno, Nev.

[73] Assignee: Game Data, Inc., Reno, Nev.

[21] Appl. No.: 561,765

[22] Filed: Nov. 22, 1995

[51] Int. Cl.[6] ..... A63F 3/06; G06G 7/48

[52] U.S. Cl. ..... 273/139; 463/16; 463/30

[58] Field of Search ..... 463/1, 16–21, 463/25, 30–31; 364/410–412; 273/139

[56] References Cited

U.S. PATENT DOCUMENTS

| | | | |
|---|---|---|---|
| 4,986,546 | 1/1991 | Cerulla | 273/246 |
| 5,043,889 | 8/1991 | Lucey | 463/18 |
| 5,129,652 | 7/1992 | Wilkinson | 273/139 |
| 5,374,060 | 12/1994 | Goldberg | 273/139 |
| 5,417,424 | 5/1995 | Snowden et al. | 273/139 |
| 5,489,096 | 2/1996 | Aron | 273/139 |
| 5,564,977 | 10/1996 | Algie | 463/30 |

*Primary Examiner*—Jessica Harrison

*Assistant Examiner*—Mark A. Sager

*Attorney, Agent, or Firm*—Townsend and Townsend and Crew

[57] ABSTRACT

A method of wagering on an competitive event pitting at least two competitors against one another includes providing initial odds as an indication of one of the two participants winning the event, and establishing a betting time period preceding the event that comprises a number of successive wagering intervals, during each of which wagers on an outcome of the event are taken. For each of the successive wagering intervals the initial odds are recalculated based upon all wagers taken up to the point of the recalculation. Each wager placed is recorded by a wager ticket the carries indicia of the one of the successive wagering intervals during which the wager was taken so that payout on the wager, in the event a correct decision on the outcome of the event was made, as indicated by the wager ticket, will be based upon the odds recalculated during the one of the successive wagering time periods during which the wager was taken.

14 Claims, 1 Drawing Sheet

WAGERING SYSTEM

BACKGROUND OF THE INVENTION

The present invention relates generally to a system for wagering on the outcome of competitive events, and particularly to a wagering system that includes the concepts of pair-mutuel betting.

In the United States, and some other countries, betting on various competitive events, such as horse racing, dog racing, or jai alai, uses a pari-mutuel betting system. Pari-mutuel betting often involves placing bets on the outcome of an event. When all bets are placed, the wagering facility (e.g., race track ownership) will deduct taxes, profits, and other fees, and what is left is paid out to the betters who have correctly determined, and bet upon, the outcome of the event.

Typically, events are preceded by a predetermined time period of time ("betting period") which wagers on the outcome of the event may be made. Some events precede the betting period with a display, for each competitor, of "odds," a value indicative of the competitor's chances of winning the event. In horse racing, for example, such initial values, called the "Morning Odds Line" or just the Morning Line, is established by the event regulator (i.e., race track management) and displayed on an odds board for viewing. The predetermined betting period is opened, and wagers placed upon the various horses. At the close of the betting period the odds are recalculated, based upon the wagers placed, and displayed. Payment to those who correctly determined and bet upon the outcome of the event based upon the ultimate, recalculated odds.

The unfairness of a pari-mutuel betting system should be evident: what might appear initially as an astute bet (a horse, for example, with odds of 5 to 1) may ultimately result in a less attractive bet (even money) at the close of the wagering period.

Some feel that a fairer system exists in the United Kingdom which still uses the old bookmaker type of betting, a person who establishes his/her own odds, and issues a slip memorializing a wager with odds stated for a particular horse at that point in time of the wager. According to this system, a wager placed on a horse at specified odds (e.g., 10 to 1), and subsequent reestablishes the odds with that particular bookmaker at a later time to be 2 to 1, or some other value, the person making the bet at the 10 to 1 odds will receive a pay-off according to those odds—should the horse win. It can be seen, therefore, that this wagering system is inherently fair to the one making the wager because it more accurately represents circumstances existing when the wager was made.

SUMMARY OF THE INVENTION

The present invention is a method of pari-mutuel wagering on competitive events that provides the wagering participants a fairer return on their wagers than has heretofore been provided by conventional pari-mutuel betting. The method includes preceding an event providing with betting time period comprising a number of successive wager intervals within which wagers on the outcome of the event may be placed. Prior to each wager interval, odds indicative of each event's participant winning the event, are displayed. At the conclusion of each wager interval, and preceding the immediately following wager interval, recalculation of the odds for each event's participant is made, based upon wagers placed during the prior wager interval. Any wager placed during a wager interval will have the odds applied to that wager that are recalculated at the conclusion of the wager interval.

A system for implementing the method includes a central processor unit coupled to a plurality of wager stations and a display board. Wagers are made at the wager stations, whereat the amount of the wager, and the identity of the event's participant upon which the wager is placed, are entered. The central processing unit maintains an ongoing recalculation of the odds, based upon wagers made up to the point of recalculation, and determines the predetermined wager intervals. At the conclusion of each wager interval the odds recalculated for the immediately preceding wager interval are displayed on the display board. Additionally, each wager station provides a wager ticket, memorializing the wager placed by identifying (in addition to the amount of the wager, the object of the wager, and the event) an identification of the wager interval in which the wager was placed. When the wager ticket identifies a winning participant of the event, the wager ticket can be redeemed at the odds value established for that wagering time period.

DESCRIPTION OF THE PREFERRED EMBODIMENT

Although the present invention is applicable as a wagering system for any competitive event involving two or more event participants, it finds particular advantage in those competitive events that are each preceded by a betting period of predetermined time within which wagers may be placed respecting the outcome of the event. Examples of such events are dog racing and horse racing. The invention is described in the context of horse racing, but as will become apparent can be used in other competitive events.

The invention modifies the conventional pari-mutuel betting system presently in use at many U.S. horse-racing events by dividing the usual betting period that precedes an event into a number of consecutive wager intervals within which wagers may be placed on the outcome of the event. At the outset, as with conventional pari-mutuel betting, each horse participating in the event is artificially handicapped by, for example, the event manager (i.e., track management) with a value (odds) indicative of the horse's chances of winning the event. At the conclusion of each wager interval, and before commencement of the immediately successive wager interval, odds for each participant horse are calculated according to all wagers placed during all preceding wager intervals. Wagers placed during the immediately preceding wager interval period acquire those odds as to the bet. The odds are displayed ("posted") for the next wager interval, and again wagers taken. At the conclusion of the betting period, e.g., all wager intervals, the odds for each individual wager interval are displayed.

In addition, each wager placed is memorialized with a wager ticket that identifies (1) the race, (2) the amount of the wager, and in accordance with this invention (3) an indicia that relates the wager to the wager interval and, therefore, the odds calculated at the conclusion of that wager interval.

Accordingly, while only the initial wager interval will be preceded with display of artificially created odds for each participant horse of an upcoming event, displayed odds for all successive wager intervals of a betting period will be based upon all wagers up to the opening for wagers of such wager interval. Further, each wager will have those odds calculated at the conclusion of the wager interval within which such wager was placed.

Figure 1:
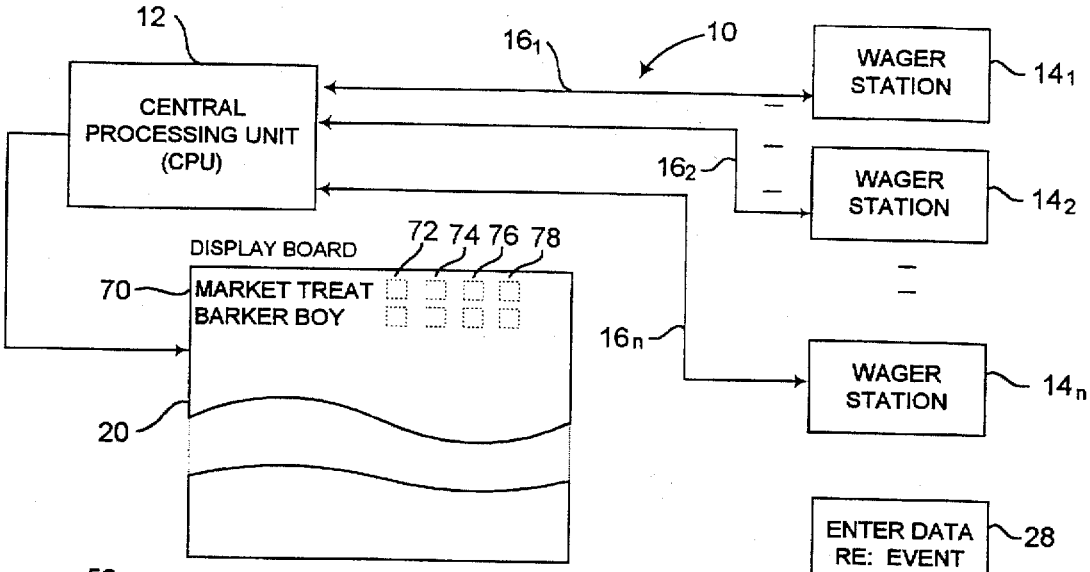
FIG. 1 is an illustration of a simplified representation of a wagering system capable of implementing the method of the present invention.

One implementation of the invention is illustrated in FIG. 1. As FIG. 1 shows, a wager system for implementing the method of the present invention, designated generally with the reference numeral 10, includes a central processing unit (CPU) 12 connected to a number of wager stations 14 ($14_1$, $14_2$, . . . , $14_n$) by signal lines 16 ($16_1$, $16_2$, . . . , $16_n$). The CPU 12 is also connected to one or more display boards 20 which will display, for any given horse race event, the participants of that event, and other information as will be described below.

Each wager station 14 preferably includes a wager ticket dispensing mechanism (not shown) of conventional design and operation, with the exception that such mechanism will include the capability of providing each issued wager ticket with indicia that accurately identifies the wager interval within which a wager memorialized by the wager ticket is made. The reasons for this additional capability will become evident below.

Figure 2:
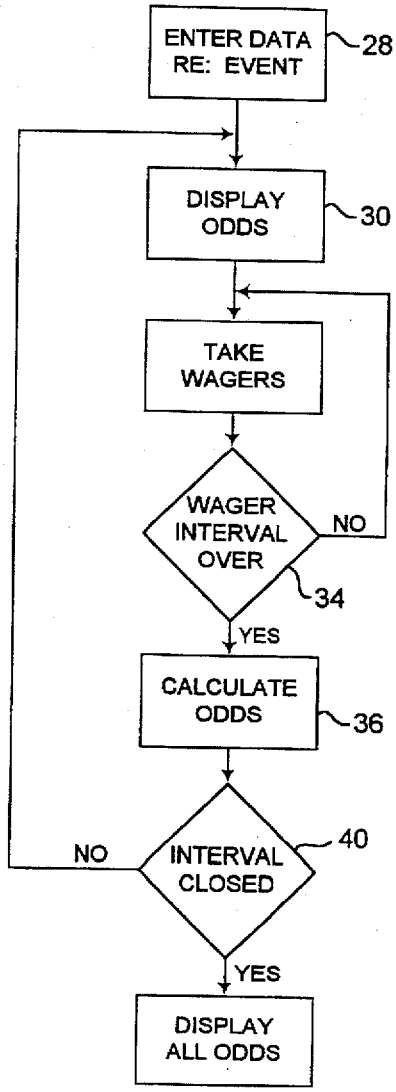
FIG. 2 is a flow diagram representation of the method of the present invention, as implemented by the system of FIG. 1.

Illustrative of the steps to be taken for implementing the present invention by the system 10 of FIG. 1 is the flow diagram of FIG. 2. According to the present invention, at some time preceding each event data respecting any upcoming event will be introduced to the system 10 (e.g., by keyboards, etc.), including the identity of each horse participating in the event and the odds of the horse's chances of winning the event at step 28. As has been done before, the odds are artificially generated, for example, by track management. The betting period preceding the event opens, at step 30, with the identity of each horse participating in the event being displayed on display board 20, along with the horse's "morning line" (i.e., the (artificially generated) odds. The CPU 12 will display the morning line on the display board 20, or other display boards, to be used during the initial wager interval opened at step 30.

During this initial wager interval, in step 32, wagers may be placed. Step 34 checks to determine whether or not the particular wager interval has concluded. If not, wagers may continue to be taken. During such wager interval each wager is, of course, memorialized by providing the one placing the wager with a wager ticket identifying the wager placed.

When the initial wager interval is determined to have concluded by step 34, the odds on each horse participating in the up-coming event are calculated—based upon the wagers taken thus far. If no wagers were taken for the participating horse, the morning line is again used; otherwise, the calculated odds are used. The odds established in step 36 will be applicable to the wagers made during the wager interval just concluded in determining payout on winning wagers. Wager tickets memorializing wagers are marked in a manner that correlates them to the particular wager time period during which the wager was placed.

At step 40, the CPU 12 determines if the wager interval just concluded was the last of the particular event betting period. If not, the odds as calculated at the close of the immediately preceding wager interval period are displayed by CPU 12 on the display board 20 at step 30, and the next wager interval is opened for additional wagers at step 32.

When all wager intervals have completed, concluding the event betting period, the odds for all wager intervals are then displayed on the display board 20, for each participating horse.

Figure 3:
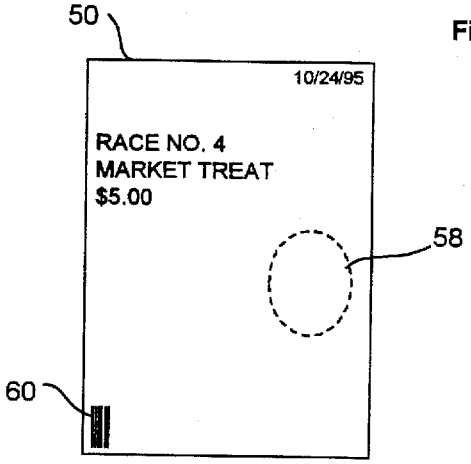
FIG. 3 is a representation of a wager ticket identifying the particulars of the wager, including the wager interval within which the wager was placed.

Referring now to FIG. 3, illustrated is a representative wager ticket 50 used to memorialize a wager placed. As is usual, the wager ticket will provide information as to the wager made, including the date, the participant horse upon which the wager was placed, the event, and the amount of the wager. In addition, the wager ticket 50 will include some indication that identifies the particular wager interval within which the wager was placed. Such indicia may be made by means of the color of the wager ticket itself, or a stamp, such as at 52, of a color, or bar code marking 60 which may also include all of the above information so that, when redeemed, a bar code reader (not shown) may be used to validate winning wager tickets.

Preferably, the wager ticket 50 will be marked with a color (which, as indicated could be by the color of the wager ticket 50 itself, or a mark 58 that is colored) to correlate the memorialized wager to the wager interval. Then, at the conclusion of the event betting period, (if comprising four wager intervals) the display board will display, for each participating horse, the odds ultimately calculated at the conclusion of each wager interval in a color the same as that of a wager ticket, or the color used to mark the wager ticket 50 at 58. Thus, if the interval is divided into four wager time periods, the display board 20 would display, at 70 (horse: "Market Treat") the odds calculated for each time period at 72, 74, 76, and 78 that corresponds to the color of the wager ticket 50, or the mark or stamp 58. The odds for the particular wager are thereby fixed at those that are calculated at the conclusion of the wager time period within which the wager was placed.

In summary, there has been disclosed a betting system that provides a return on wagers that more closely tracks the circumstances upon which the wager may be based. This is accomplished by recalculating odds at the conclusion of each of a number of successive wager intervals, and providing wagers made during each interval the benefit of those recalculated odds, as well as providing prospective wagerers with a display of those recalculated odds at the beginning of each following wager interval.

It will be evident, however, that while the invention has been described in terms of wagers based upon a determination of a winner of an event, that the betting system can also be used with wagers upon second ("show") and third ("place") finishers. It may also apply to wagers made on Exactas, Quinellas, Perfectas, Trifectas, and other wagers opportunities.

What is claimed is:

1. A method of wagering on an competitive event, including the steps of:

providing a value indicative of an outcome of the competitive event;

establishing a time period comprising a number of successive wagering intervals preceding the competitive event;

taking wagers on the outcome of the competitive event during each of the number of successive wagering intervals;

for each of the number of successive wagering intervals, recalculating the value based upon the wagers taken prior to recalculation to obtain a recalculated value;

providing, for each wager placed, a record of such wager, the record including indicia of the one of the number of successive wagering interval during which such wager was taken; and paying on each wager correctly determining the outcome of the event based upon the recalculated value obtained during the one of the number of successive wagering interval during which the wager was taken.

2. The method of claim 1, wherein the number of successive wagering intervals are fixed and substantially equal to one another.

3. The method of claim 1, wherein the recalculating step occurs at the conclusion of each of the number of successive wagering intervals.

4. The method of claim 1, wherein the indicia used to record the wager is a colored wager ticket the color of which identifies a corresponding one of the number of successive wagering intervals.

5. The method of claim 1, wherein the indicia used to record the wager is a wager ticket that includes a colored mark to identify the one of the number of wagering intervals during which the recorded wager was taken.

6. The method of claim 1, wherein the competitive event includes at least two participants, and the outcome is one of the two participants winning the event.

7. The method of claim 6, wherein the outcome is one of the two participants not winning the event.

8. The method of claim 6, wherein the indicia used to record the wager is a wager ticket that includes information identifying the one of the two participants upon which the wager was placed, the event, and the wagering interval during which the wager was placed.

9. A wagering system for wagering on an outcome of a competitive event involving at least two participants, the system comprising:

display means for displaying an odds value for each of the two participants indicative of such participant winning the competitive event;

input means for entering a wager on the event;

processing means coupled to the display means and the input means for providing the display means with data indicative of the odds value for each of the two participants based upon wagers taken;

the processing means operating to define a betting time period comprising a number of successive wagering intervals and to calculate for each of the number of successive wagering intervals an odds value indicative of the outcome based upon wagers entered prior to each recalculation; and means for providing a record of the wager correlated to the wagering interval during which the wager was made so that in the event the wager correctly determined the outcome of the competitive event, the wager is compensated according to the odds value calculated for such wagering interval.

10. The wagering system of claim 9, wherein the record is a wager ticket with indicia identifying the event, the one of the two participants upon which the wager was placed, and the wagering interval during which the wager was placed.

11. The wagering system of claim 10, wherein the indicia identifying the wagering interval during which the wager was placed is a color of the wager ticket.

12. The wagering system of claim 11, wherein the display means operates in response to the processing means to display for each of the two participants the calculated and recalculated odds in a color that corresponds to the wager interval and wager tickets issued during such wager interval.

13. The wagering system of claim 11, wherein the display means operates in response to the processing means to display for each of the two participants the recalculated odds in a color that corresponds to the wager interval and color of the mark on the wager tickets issued during such wager interval.

14. A method of wagering on an outcome of a competitive event, including the steps of:

providing value indicative of the outcome of the competitive event;

preceding the competitive event with a number of successive wagering intervals;

accepting, during each of the number of successive wagering interval, wagers on the outcome of the competitive event;

providing, for each of the number of successive wagering intervals, a re-calculation value that is based upon prior accepted wagers;

paying on each wager correctly selecting the outcome according to the re-calculation value provided for the one of number of successive wagering interval during which such wager was accepted.

* * * * *